US007547019B2

(12) United States Patent
Chen

(10) Patent No.: US 7,547,019 B2
(45) Date of Patent: Jun. 16, 2009

(54) THREE-DIMENSIONAL DIY ASSEMBLY INTELLIGENCE STRUCTURE

(76) Inventor: Ying-Jen Chen, 8Fl., 145, Hung Chang 6th Street, Taoyuan (TW)

( * ) Notice: Subject to any disclaimer, the term of this patent is extended or adjusted under 35 U.S.C. 154(b) by 176 days.

(21) Appl. No.: 11/723,404

(22) Filed: Mar. 19, 2007

(65) Prior Publication Data

US 2008/0230989 A1 Sep. 25, 2008

(51) Int. Cl.
*A63F 9/08* (2006.01)

(52) U.S. Cl. ..... 273/153 S; 273/156

(58) Field of Classification Search ..... 273/153 S, 273/156, 157 R
See application file for complete search history.

(56) References Cited

U.S. PATENT DOCUMENTS 3,081,089 A * 3/1963 Gustafson ..... 273/156
4,487,585 A * 12/1984 Goldwasser ..... 273/156
4,522,401 A * 6/1985 Gustafson ..... 273/153 S
4,856,786 A * 8/1989 Gyovai ..... 273/153 S
5,333,869 A * 8/1994 Hsun ..... 273/153 S
5,452,895 A * 9/1995 Ray ..... 273/153 S
5,566,941 A * 10/1996 Destics ..... 273/153 S
6,857,632 B2 * 2/2005 Tanner ..... 273/153 S

* cited by examiner

*Primary Examiner*—Steven Wong
(74) *Attorney, Agent, or Firm*—Troxell Law Office, PLLC

(57) ABSTRACT

The present invention relates to a three-dimensional DIY assembly intelligence structure, which is a three-dimensional rotatable structure. The three-dimensional rotatable structure comprises a detachable puzzle piece, several square puzzle pieces, several rectangular puzzle pieces, several triangular puzzle pieces. The three-dimensional rotatable structure is composed of twenty-six puzzle pieces including one detachable puzzle piece, five square puzzle pieces, twelve rectangular puzzle pieces, and eight triangular puzzle pieces. The three-dimensional rotatable structure has a sphere shape, and it combines a jigsaw puzzle, a smart box, a Rubik's Cube and a pet egg. Therefore, it is a more challenging intelligence game.

3 Claims, 8 Drawing Sheets

THREE-DIMENSIONAL DIY ASSEMBLY INTELLIGENCE STRUCTURE

FIELD OF THE INVENTION

The present invention relates to a three-dimensional DIY (Do-It-Yourself) assembly intelligence structure, and more practically to a three-dimensional rotatable structure that combines a jigsaw puzzle, a puzzle box, a RUBIK'S CUBE puzzle and a pet egg. When the three-dimensional rotatable structure is half assembled, the reward such as the pet egg, the doll or the gift can be put thereinto before completing the assembly process. In addition, the pattern of three-dimensional rotatable structure can be disordered and locked by rotation so it can act as a puzzle structure to allow the user or other person to find a way to recover the original predetermined pattern and to disassemble the three-dimensional rotatable structure to get the reward located therein.

BACKGROUND OF THE INVENTION

The conventional Rubik's Cube is a 3×3×3 cube, and it is developed into a 4×4×4 cube and a 5×5×5 cube. However, the playing methods of these conventional RUBIK'S CUBE puzzles do not beyond the scope of disordering the originally integrated color or pattern before finding a way to recover this originally integrated color or pattern design.

However, these conventional RUBIK'S CUBE puzzles are boring and lack of innovation. In view of the drawbacks of the conventional RUBIK'S CUBE puzzles, the present invention discloses a whole new three-dimensional DIY assembly intelligence structure, which integrates a jigsaw puzzle, a puzzle box, a RUBIK'S CUBE puzzle and a pet egg into a unity.

SUMMARY OF THE INVENTION

The present invention improves the interest and challenge in operating the three-dimensional rotatable structure. The object of the present invention is to provide a three-dimensional DIY assembly intelligence structure, which can be assembled by the user to obtain a predetermined pattern. In addition, the three-dimensional DIY assembly intelligence structure is rotatable like a RUBIK'S CUBE puzzle and its puzzle pieces can be interlocked with one another after rotation. In addition, it becomes more and more disordered after further rotations. Moreover, the three-dimensional DIY assembly intelligence structure can be disassembled again once the predetermined pattern is recovered.

The present invention is characterized in that:

1. Any predetermined pattern can be printed on the surface of the three-dimensional rotatable structure according the customer's requirement.

2. All the puzzle pieces can be assembled by the player.

3. The three-dimensional rotatable structure is constituted by 26 puzzle pieces and it is rotatable like the RUBIK'S CUBE puzzle. In addition, its puzzle pieces can be interlocked with one another after rotation. Moreover, the three-dimensional rotatable structure can be disassembled again once the predetermined pattern is recovered.

4. The three-dimensional rotatable structure has a hollow inside for holding a gift, a doll, or a fashion pet egg. After recovering the predetermined pattern by rotation, the three-dimensional rotatable structure can be disassembled to award the player the gift located thereinside.

5. A jigsaw puzzle, a puzzle box, a RUBIK'S CUBE puzzle and a pet egg are integrated into the three-dimensional DIY assembly intelligence structure of the present invention to provide a challenging intelligence game.

BRIEF DESCRIPTION OF THE DRAWINGS

These and other features, aspects and advantages of the present invention will become better understood with regard to the following description, appended claims, and accompanying drawings, wherein:

DETAILED DESCRIPTION OF THE PREFERRED EMBODIMENT

Figure 1:
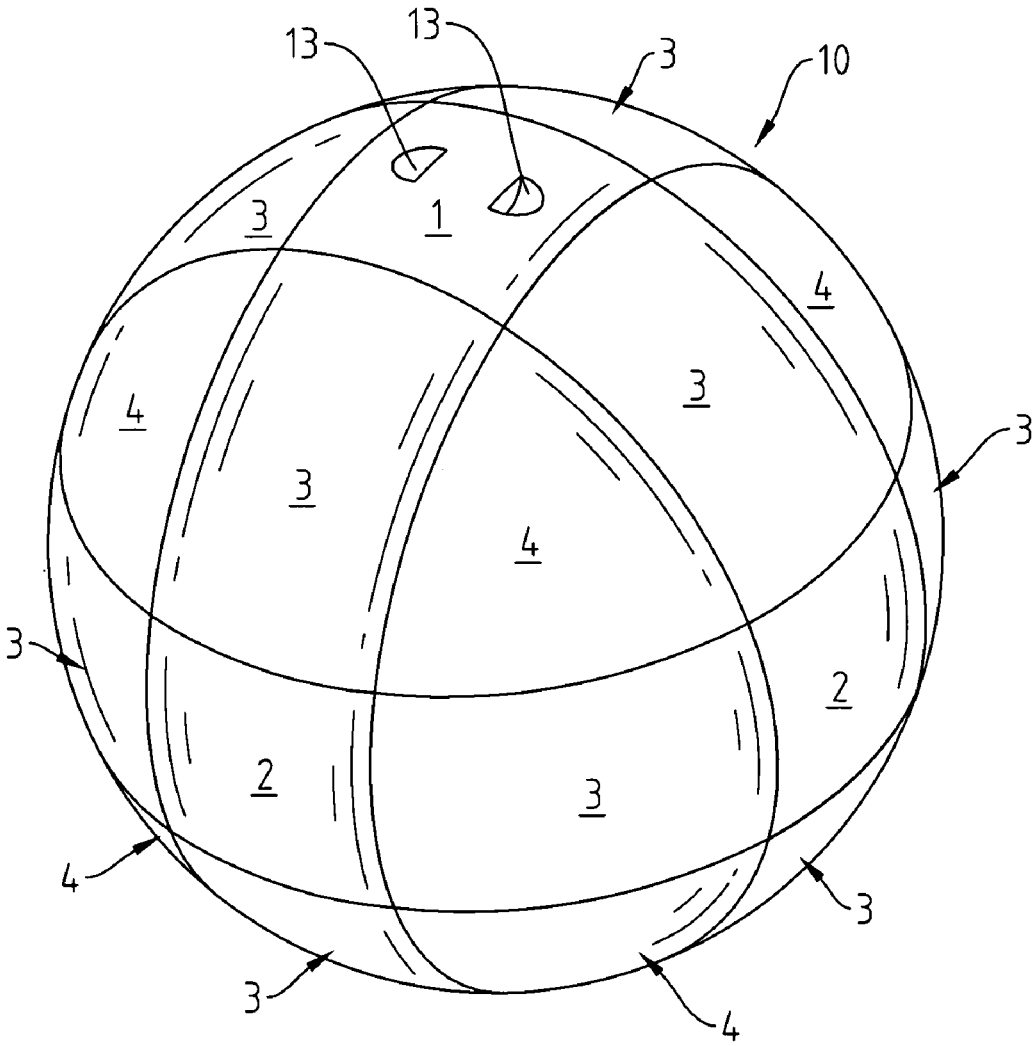
FIG. 1 is a three-dimensional view showing the three-dimensional rotatable structure of the present invention.
Figure 2:
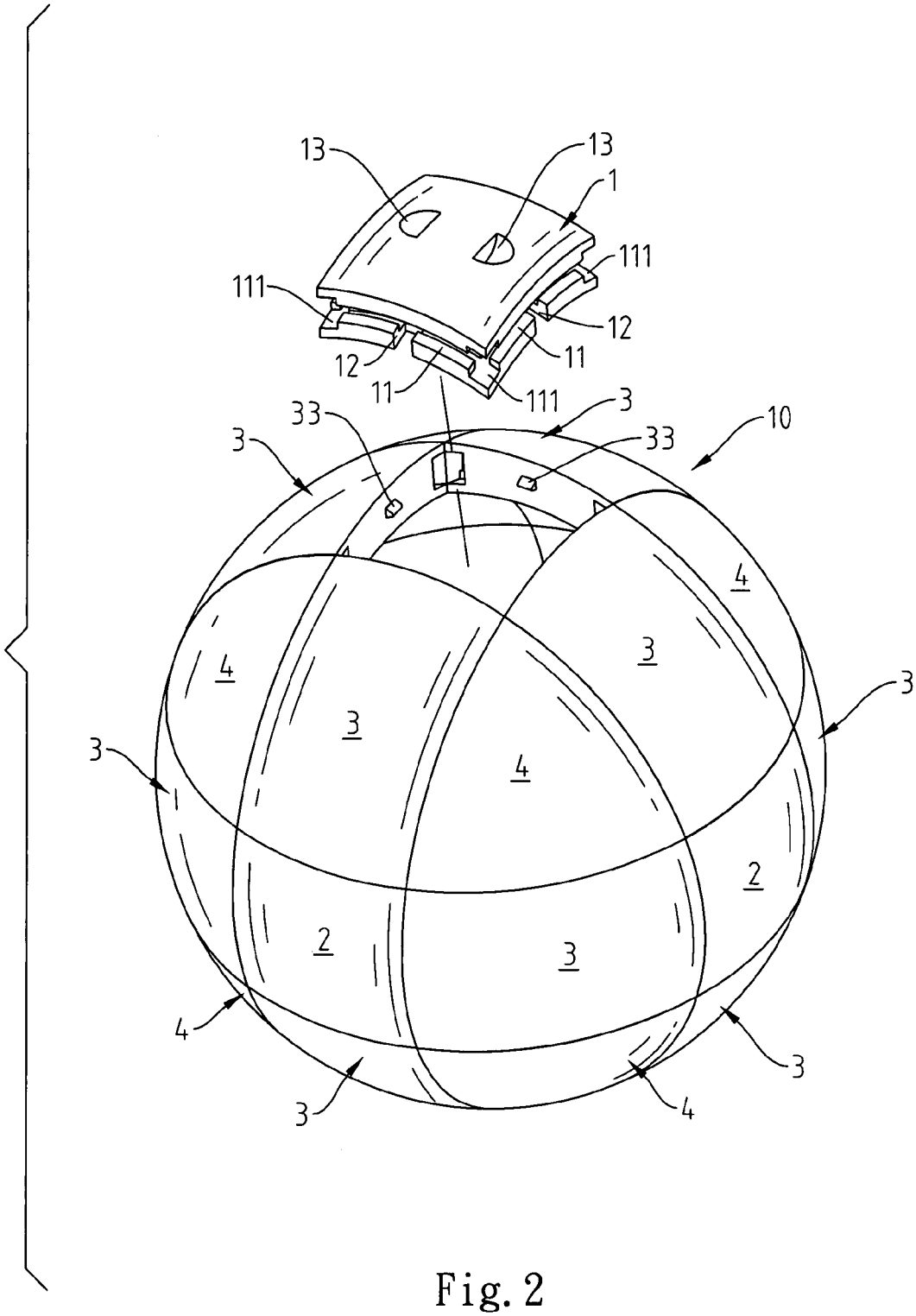
FIG. 2 is a partial decomposed, three-dimensional view showing the three-dimensional rotatable structure of the present invention.
Figure 3:
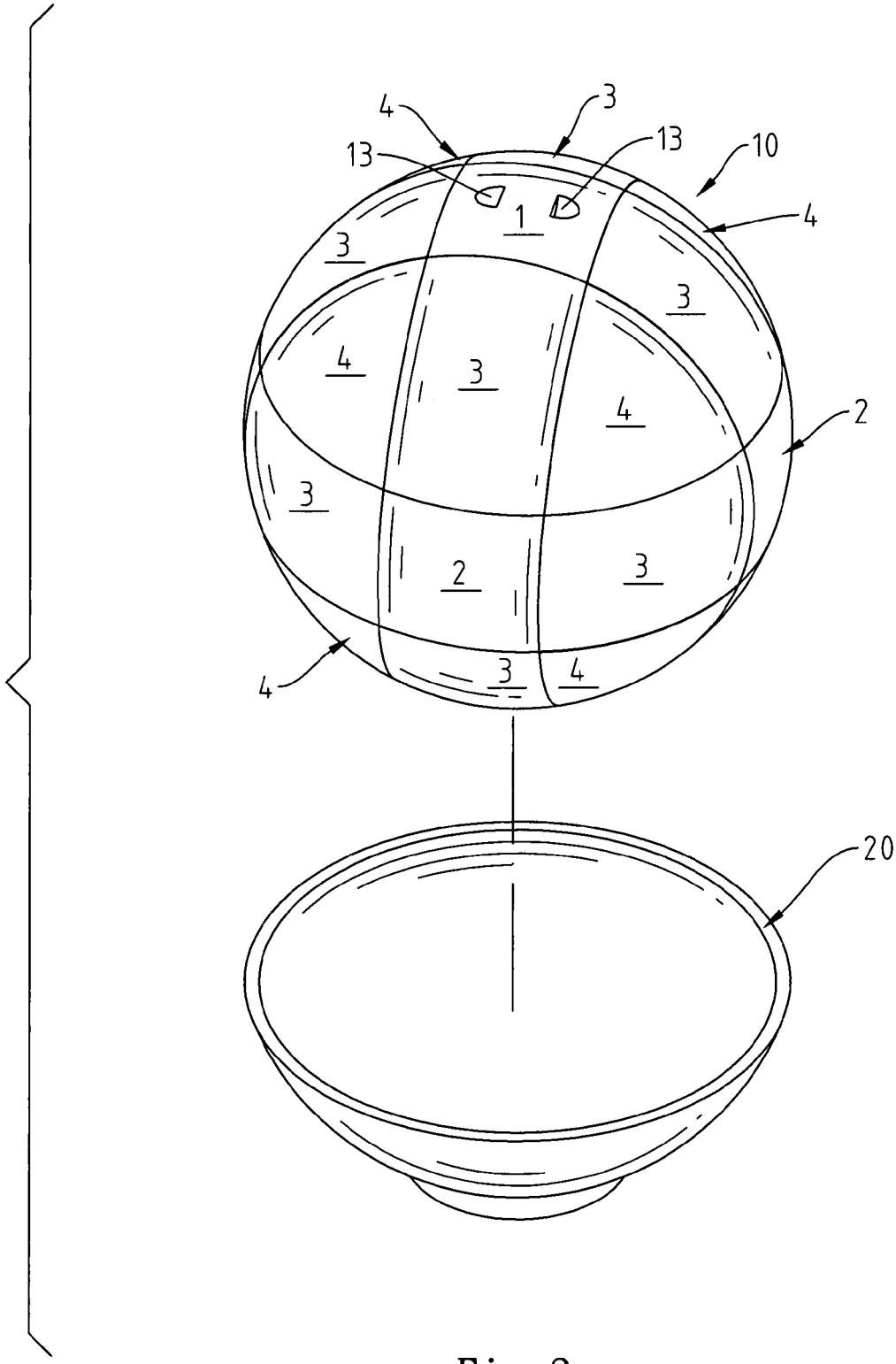
FIG. 3 is a three-dimensional view showing the three-dimensional rotatable structure and the bracket of the present invention.

Referring to FIG. 1 through FIG. 3, a three-dimensional rotatable structure 10 in accordance with a preferred embodiment of the present invention generally comprises a detachable puzzle piece 1, several square puzzle pieces 2, several rectangular puzzle pieces 3 and several triangular puzzle pieces 4. As shown in these figures, the three-dimensional rotatable structure 10 in accordance with this preferred embodiment of the present invention is composed of twenty-six puzzle pieces including one detachable puzzle piece 1, five square puzzle pieces 2, four rectangular puzzle pieces 3, eight rectangular puzzle pieces of different structures 3 and eight triangular puzzle pieces 4. The three-dimensional rotatable structure 10 that consists of twenty-six puzzle pieces temporally constitutes a sphere structure.

A bowl-shaped bracket 20 is provided for initially positioning the three-dimensional rotatable structure 10 during its assembly process to prevent it from disorderliness and to hold it when not in use. The bracket 20 is made of a transparent or semi-transparent material so as to see the patterns on the surface of the three-dimensional rotatable structure 10 when it is held in the bracket 20.

Figure 4:
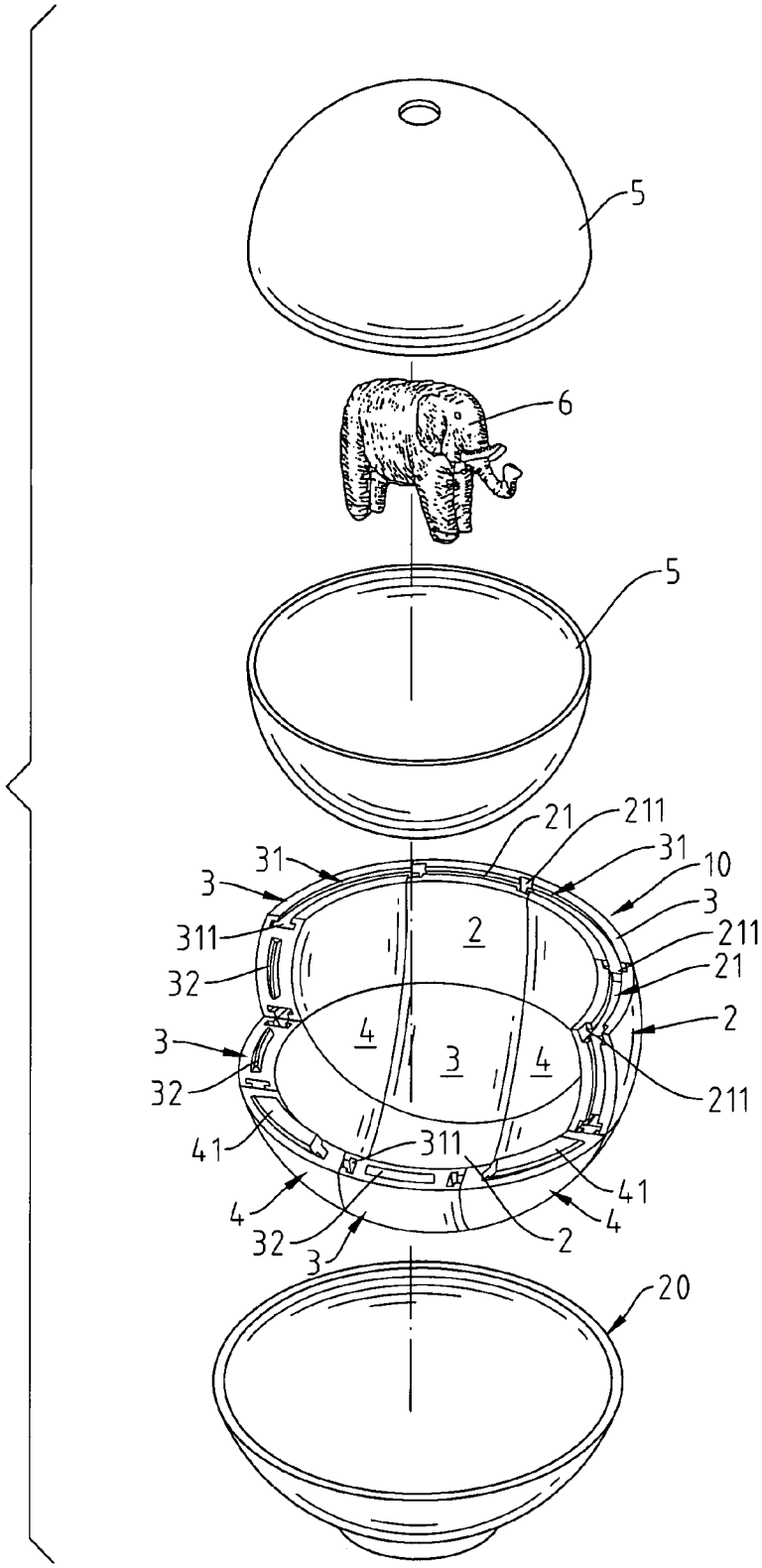
FIG. 4 is a three-dimensional decomposed view showing the three-dimensional rotatable structure of the present invention.

Referring further to FIG. 4, a hollow sphere structure 5 can be held inside the three-dimensional rotatable structure 10, wherein a gift 6 such as any toy or doll can be put into the hollow sphere structure 5 so as to constitute a fashion pet egg.

Figure 5:
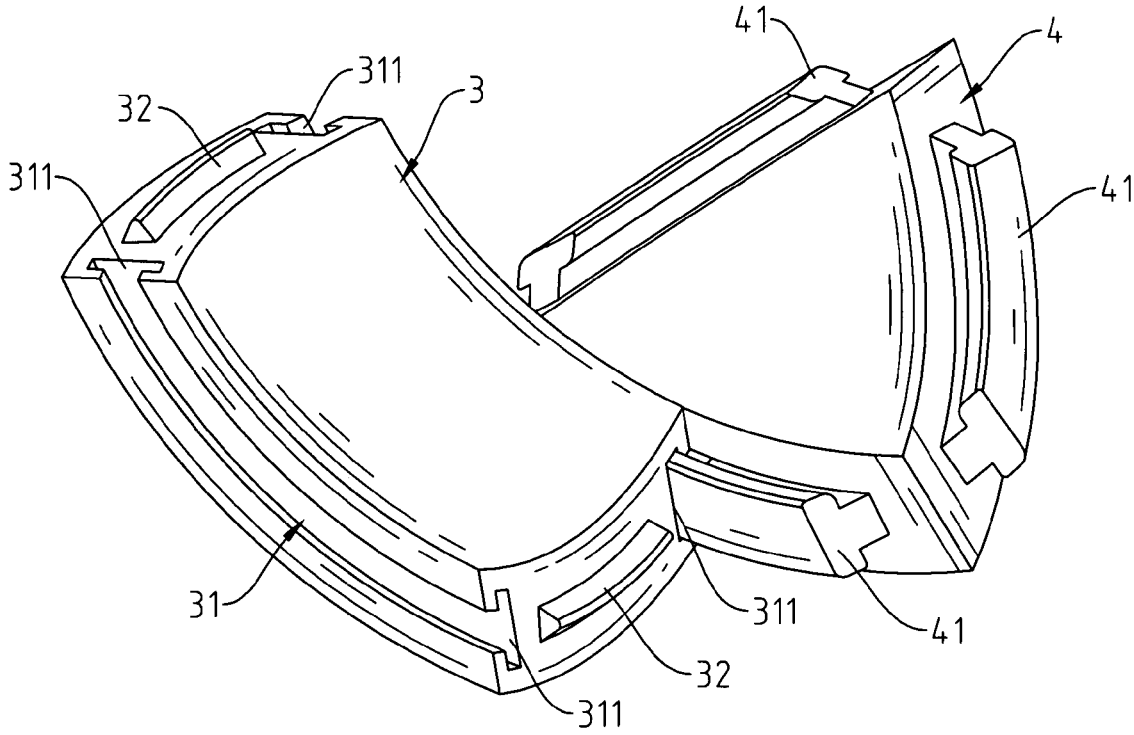
FIG. 5 is a partial assembled, three-dimensional view showing the three-dimensional rotatable structure of the present invention.

Referring to FIG. 2, FIG. 4 and FIG. 5, the three-dimensional rotatable structure 10 is shown, wherein it is composed of twenty-six puzzle pieces including one detachable puzzle piece 1, five square puzzle pieces 2, four rectangular puzzle pieces 3, eight rectangular puzzle pieces of different structures 3 and eight triangular puzzle pieces 4.

Figure 6:
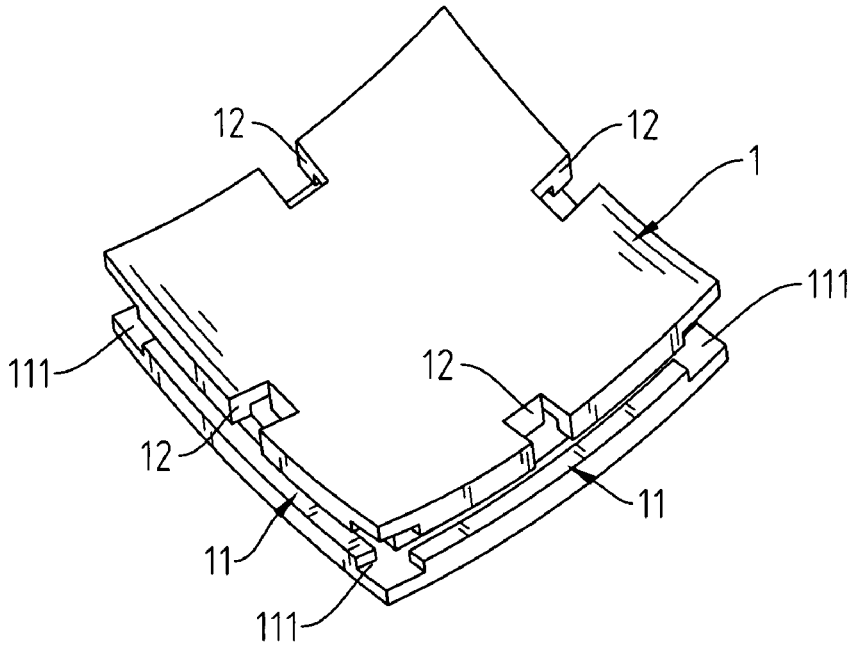
FIG. 6 is a three-dimensional decomposed view showing the detachable puzzle piece of the present invention.
Figure 7:
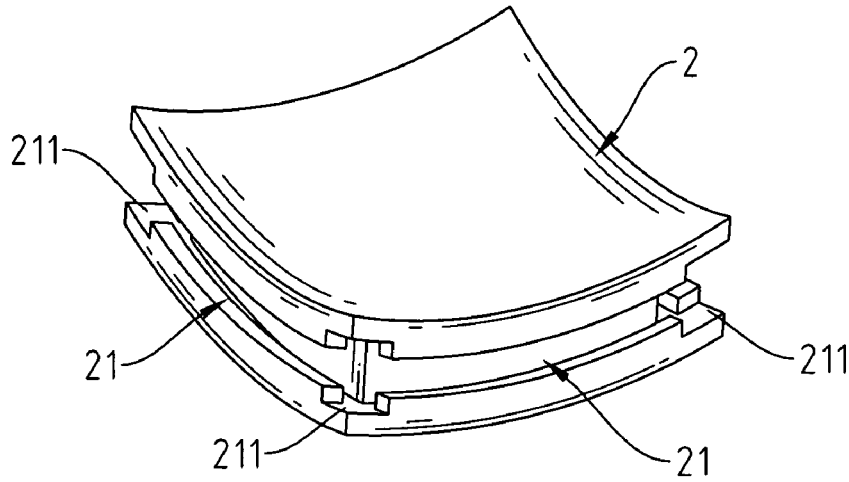
FIG. 7 is a three-dimensional decomposed view showing the square puzzle piece of the present invention.
Figure 8:
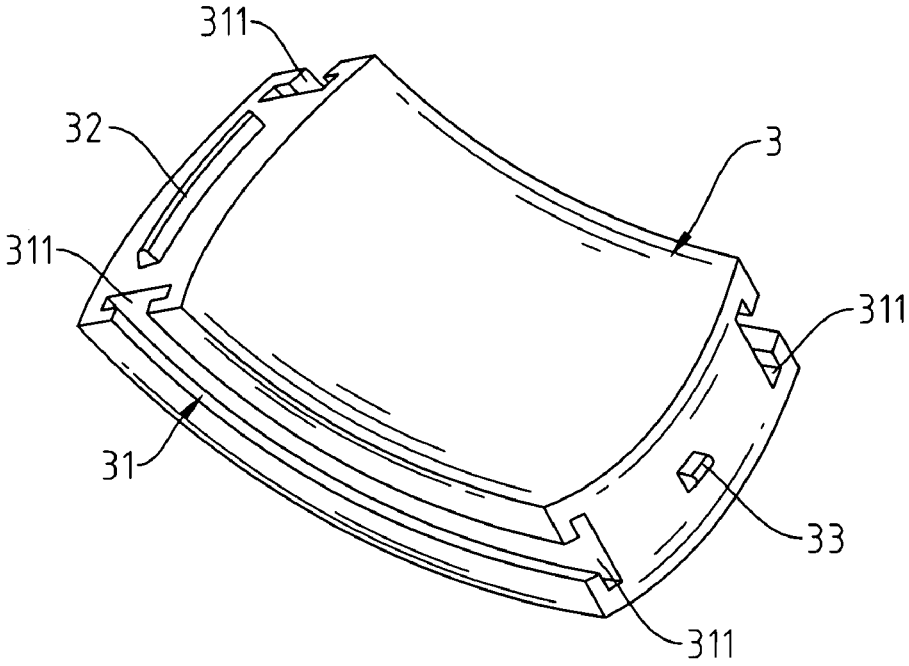
FIG. 8 is a three-dimensional decomposed view showing the rectangular puzzle piece of the present invention.
Figure 9:
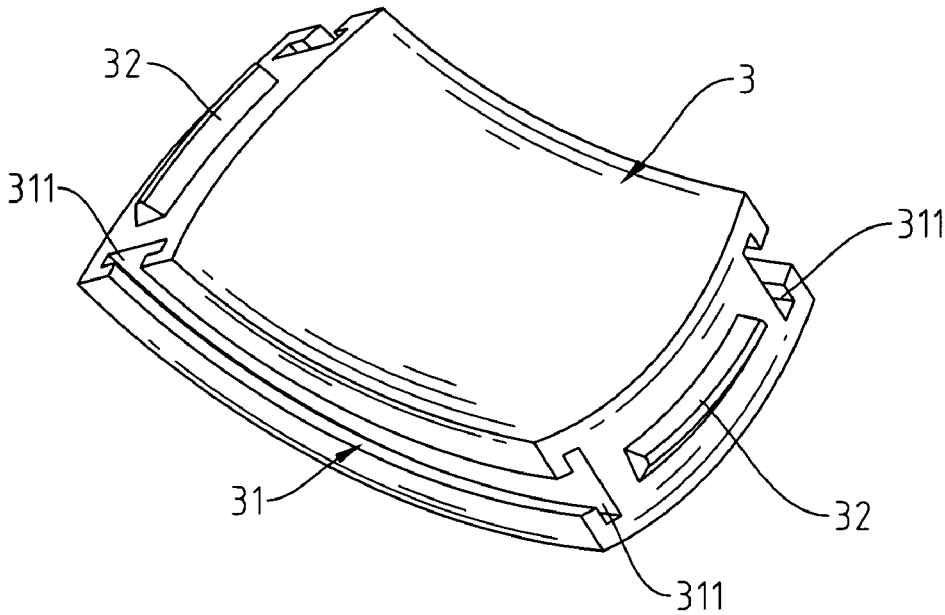
FIG. 9 is a three-dimensional decomposed view showing another rectangular puzzle piece of the present invention.

The structures of the detachable puzzle piece 1 and the square puzzle pieces 2 are shown in FIG. 2, FIG. 6 and FIG. 7. The detachable puzzle piece 1 and the square puzzle pieces 2 are arched-square puzzle pieces having slide chutes 11, 21 on the respective edges, wherein the slide chutes 11, 21 are configured to communicate with each other. In addition, the detachable puzzle piece 1 and the square puzzle pieces 2 further have coupling gaps 111, 211 at the four respective corners for coupling to other puzzle pieces. In addition, the detachable puzzle piece 1 has grasp parts 13 on the surface and recessed openings 12 on the respective edges of four slide chutes 11. During the assembly process, the detachable puzzle piece 1 is the final piece to be assembled.

Figure 10:
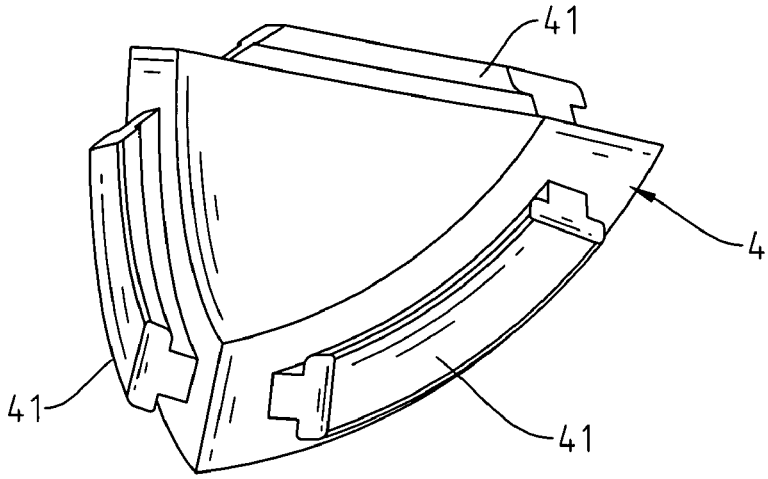
FIG. 10 is a three-dimensional decomposed view showing the triangular puzzle piece of the present invention.

Referring to FIG. 4, FIG. 5, FIG. 8 and FIG. 9, the structure of the rectangular puzzle piece 3 is shown. Each of the rectangular puzzle pieces 3 has two slide chutes 31 on two respective long sides, wherein each of the slide chutes 31 has two coupling gaps 311 on two respective ends. There are four rectangular puzzle pieces 3 each having a protrusion rib 32 and a jamming block 33 on opposite respective short sides to facilitate coupling to the detachable puzzle piece 1, wherein the jamming blocks 33 can be engaged with the recessed openings 12 when the detachable puzzle piece 1 is finally assembled. The remaining rectangular puzzle piece 3 have two protrusion ribs 32 on two respective short sides to prevent separation of the square puzzle pieces 2 from upper or lower portions of the rectangular puzzle pieces 3 when they are coupled together. Referring FIG. 4, FIG. 5 and FIG. 10, the structure of the triangular puzzle piece 4 is shown, wherein each of the triangular puzzle pieces 4 has three T-shaped slide bars 41 on respective three sides. When the triangular puzzle pieces 4 are coupled to the detachable puzzle piece 1, the square puzzle pieces 2 and the rectangular puzzle pieces 3, the T-shaped slide bars 41 of the triangular puzzle piece 4 can be sildably inserted into the respective slide chutes 11, 21 and 31 to prevent separation of the entire three-dimensional rotatable structure 10.

During the assembly process of the three-dimensional rotatable structure 10 of the present invention, the square puzzle pieces 2, the rectangular puzzle pieces 3 and the triangular puzzle pieces 4 are alternately assembled in sequence. If the three-dimensional rotatable structure 1 is half assembled, the hollow sphere structure 5 and the gift 6 can be put thereinto. As shown in FIG. 2, after assembling these four rectangular puzzle pieces 3 that have respective jamming blocks 33, a square gap is formed to allow the detachable puzzle piece 1 to be disposed thereon, thereby completing the three-dimensional rotatable structure 10. The assembled three-dimensional rotatable structure 10 may have any predetermined pattern printed thereon according to requirement. These twenty-six puzzle pieces of the three-dimensional rotatable structure 10 are rotatable like a RUBIK'S CUBE puzzle. The originally predetermined pattern can be locked immediately after rotation so it is very challenging and not very easy to determine the original predetermined pattern. The shape of the three-dimensional rotatable structure is not limited to a sphere. It can be configured to any appropriate shape such as a cube, octahedron, etc.

Figure 11:
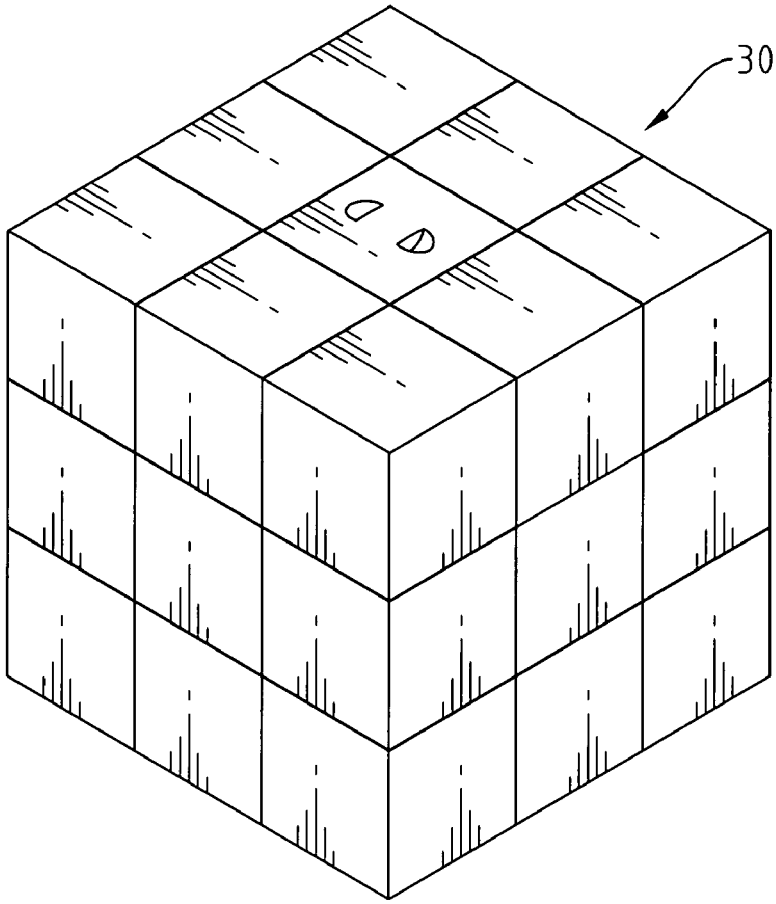
FIG. 11 is a three-dimensional decomposed view showing another cube of the present invention.

In addition, the three-dimensional rotatable structure may have a non-spherical shape. For example, a cube-shaped rotatable structure 30 is shown in FIG. 11.

To sum up, the three-dimensional rotatable structure combines a jigsaw puzzle, a puzzle box, a RUBIK'S CUBE puzzle and a pet egg. Therefore, it is a more challenging game for the player.

What is claimed is:

1. A three-dimensional DIY assembly intelligence structure, which is a three-dimensional rotatable structure consisting of twenty-six puzzle pieces, comprising:

a detachable puzzle piece having a plurality of inter-communicated slide chutes on the respective edges, a plurality of coupling gaps at four respective corners for coupling to other puzzle pieces, a plurality of grasp parts on the surface, and a plurality of recessed openings on the respective edges of said slide chutes;

a plurality of square puzzle pieces having a plurality of inter-communicated slide chutes on the respective edges and a plurality of coupling gaps at four respective corners for coupling to other puzzle pieces;

a plurality of rectangular puzzle pieces having two slide chutes on two respective long sides and two coupling gaps on two respective ends of said respective slide chutes; and a plurality of triangular puzzle pieces having a plurality of T-shaped slide bars for sildably inserting into said respective slide chutes when said triangular puzzle pieces are coupled to said detachable puzzle piece, said square puzzle pieces and said rectangular puzzle pieces to prevent separation of said entire three-dimensional rotatable structure, wherein said three-dimensional rotatable structure comprises twelve rectangular puzzle pieces, wherein eight of them have two protrusion ribs on two short sides, and four of them have a protrusion rib and a jamming block on respective opposite short sides.

2. A three-dimensional DIY assembly intelligence structure of claim 1, wherein a hollow sphere structure and a gift can be put into said three-dimensional rotatable structure.

3. A three-dimensional DIY assembly intelligence structure of claim 1, wherein a bowl-shaped bracket is provided to initially position said three-dimensional rotatable structure during its assembly process and to hold it for use.

* * * * *